US006423183B1

(12) United States Patent
Goulet et al.

(10) Patent No.: US 6,423,183 B1
(45) Date of Patent: Jul. 23, 2002

(54) PAPER PRODUCTS AND A METHOD FOR APPLYING A DYE TO CELLULOSIC FIBERS

(75) Inventors: Mike Thomas Goulet, Appleton; Jill A. Georger, Neenah, both of WI (US); Denise Alice Polderman, Martinez; Maurice Alan Wyatt, Evans, both of GA (US); Victor Michael Gentile, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/303,344

(22) Filed: Apr. 30, 1999

Related U.S. Application Data

(63) Continuation-in-part of application No. 09/010,675, filed on Jan. 22, 1998.
(60) Provisional application No. 60/071,468, filed on Dec. 24, 1997.

(51) Int. Cl.[7] ..... D21H 11/00
(52) U.S. Cl. ..... 162/182; 162/9; 162/158; 162/162; 162/181.2; 162/189; 162/190; 162/181.1; 162/123; 162/126; 162/127; 162/132; 162/134
(58) Field of Search ..... 162/9, 100, 158, 162/162, 179, 181.2, 182, 164.3, 164.6, 168.2, 168.3, 189, 190, 181.1, 123, 126, 127, 132, 134

(56) References Cited

U.S. PATENT DOCUMENTS

| | | | | |
|---|---|---|---|---|
| 1,812,832 A | | 6/1931 | Rafton | |
| 3,056,714 A | | 10/1962 | Feigley, Jr. et al. | 162/155 |
| 3,677,886 A | | 7/1972 | Forssblad et al. | 162/72 |
| 3,770,575 A | | 11/1973 | Ball | |
| 3,821,073 A | * | 6/1974 | Eriksson | 162/126 |
| 3,994,771 A | | 11/1976 | Morgan, Jr. et al. | 162/113 |
| 4,014,736 A | | 3/1977 | Sexton | 162/38 |

(List continued on next page.)

FOREIGN PATENT DOCUMENTS

| | | |
|---|---|---|
| EP | 0 109 282 A2 | 5/1984 |
| EP | 0 226 408 A2 | 6/1987 |
| EP | 0 613 979 A1 | 9/1994 |
| EP | 0 851 062 A2 | 7/1997 |
| EP | 0 643 164 B1 | 11/1997 |
| WO | WO 89/02952 A1 | 4/1989 |
| WO | WO 90/12146 A1 | 10/1990 |

(List continued on next page.)

OTHER PUBLICATIONS

Gary A. Smook, "Handbook for Pulp and Paper Technologists, 2nd Edition", Angus Wilde Publications, pp. 220 and 225–226, 1992.*

G.A. Smook, *Handbook for Pulp and Paper Technologies*, 2nd Edition 1992, pp. 225–226.

*Primary Examiner*—Stanley S. Silverman
*Assistant Examiner*—Dionne A. Walls
(74) *Attorney, Agent, or Firm*—Thomas J. Connelly; Patricia A. Charlier

(57) ABSTRACT

Chemical additives can be adsorbed on cellulosic papermaking fibers at high levels with a minimal amount of unadsorbed chemical additives present in the papermaking process water. A method includes treating a fiber slurry with an excess of the chemical additive, allowing sufficient residence time for adsorption to occur, filtering the slurry to remove unadsorbed chemical additives, and redispersing the filtered pulp with fresh water. Filtrate from the thickening process contains unadsorbed chemical additive and it is not sent forward in the process with the chemically treated fibers. The method can be employed to make improved paper products.

48 Claims, 3 Drawing Sheets

U.S. PATENT DOCUMENTS

| | | | | | |
|---|---|---|---|---|---|
| 4,049,493 | A | | 9/1977 | Lare | 162/157 R |
| 4,081,319 | A | | 3/1978 | Conway | 162/168 NA |
| 4,093,506 | A | | 6/1978 | Richter | 162/17 |
| 4,144,122 | A | | 3/1979 | Emanuelsson et al. | 162/158 |
| 4,310,384 | A | | 1/1982 | Meredith et al. | 162/60 |
| 4,383,834 | A | * | 5/1983 | Degen et al. | 8/551 |
| 4,448,638 | A | | 5/1984 | Klowak | 162/112 |
| 4,481,076 | A | | 11/1984 | Herrick | |
| 4,481,077 | A | | 11/1984 | Herrick | 162/158 |
| 4,482,429 | A | | 11/1984 | Klowak | 162/111 |
| 4,624,743 | A | * | 11/1986 | Gess | 162/164.1 |
| 4,808,266 | A | | 2/1989 | Faurie | 162/102 |
| 4,908,101 | A | | 3/1990 | Frisk et al. | 162/261 |
| 4,969,976 | A | | 11/1990 | Reed | |
| 4,986,882 | A | | 1/1991 | Mackey et al. | 162/109 |
| 5,035,772 | A | | 7/1991 | Agnemo et al. | 162/72 |
| 5,073,234 | A | * | 12/1991 | Mollett et al. | 162/5 |
| 5,087,324 | A | | 2/1992 | Awofeso et al. | 162/111 |
| 5,102,500 | A | * | 4/1992 | Darlington | 162/5 |
| 5,127,994 | A | * | 7/1992 | Johansson | 162/168.3 |
| 5,137,600 | A | | 8/1992 | Barnes et al. | |
| 5,139,671 | A | | 8/1992 | Henricson et al. | 210/398 |
| 5,221,434 | A | | 6/1993 | Henricson | 162/52 |
| 5,238,501 | A | | 8/1993 | Kappel et al. | 134/15 |
| 5,348,620 | A | | 9/1994 | Hermans et al. | 162/9 |
| 5,397,435 | A | | 3/1995 | Ostendorf et al. | 162/112 |
| 5,405,501 | A | | 4/1995 | Phan et al. | 162/127 |
| 5,437,766 | A | | 8/1995 | Phan et al. | 162/127 |
| 5,494,554 | A | | 2/1996 | Edwards et al. | 162/111 |
| 5,501,768 | A | | 3/1996 | Hermans et al. | 162/9 |
| 5,552,020 | A | | 9/1996 | Smith et al. | 162/164.4 |
| 5,591,306 | A | | 1/1997 | Kaun | 162/127 |
| 5,603,804 | A | | 2/1997 | Hansen et al. | 162/158 |
| 5,607,551 | A | | 3/1997 | Farrington, Jr. et al. | 162/109 |
| 5,656,132 | A | | 8/1997 | Farrington, Jr. et al. | 162/117 |
| 5,667,636 | A | | 9/1997 | Engel et al. | 162/117 |
| 5,672,248 | A | | 9/1997 | Wendt et al. | 162/109 |
| 5,695,607 | A | | 12/1997 | Oriaran et al. | 162/112 |
| 5,725,736 | A | | 3/1998 | Schroeder et al. | 162/164.4 |
| 5,772,845 | A | | 6/1998 | Farrington, Jr. et al. | 162/109 |
| 5,788,815 | A | | 8/1998 | Norell et al. | |

FOREIGN PATENT DOCUMENTS

| | | |
|---|---|---|
| WO | WO 94/19534 A1 | 9/1994 |
| WO | WO 95/01479 A1 | 1/1995 |
| WO | WO 95/20066 A1 | 7/1995 |
| WO | WO 96/06223 A1 | 2/1996 |
| WO | WO 97/13026 A1 | 4/1997 |
| WO | WO 98/09021 A1 | 3/1998 |
| WO | WO 98/16570 A1 | 4/1998 |
| WO | WO 98/17864 A1 | 4/1998 |
| WO | WO 98/23814 A1 | 6/1998 |
| WO | WO 98/35095 A1 | 8/1998 |
| WO | WO 99/34057 A1 | 7/1999 |

* cited by examiner

PAPER PRODUCTS AND A METHOD FOR APPLYING A DYE TO CELLULOSIC FIBERS

This application is a continuation-in-part of application Ser. No. 09/010,675 entitled "PAPER PRODUCTS AND METHODS FOR APPLYING CHEMICAL ADDITIVES TO CELLULOSIC FIBERS" and filed in the U.S. Patent and Trademark Office on Jan. 22, 1998 which was originally filed provisionally as Ser. No. 60/071,468 on Dec. 24, 1997. The entirety of application Ser. Nos. 09/101,675 and 60/071,468 are hereby incorporated by reference.

BACKGROUND OF THE INVENTION

The present invention relates generally to paper products. More particularly, the invention concerns methods for applying chemical additives to cellulosic fibers and the paper products that can be obtained by the methods.

In the manufacture of paper products, it is often desirable to enhance physical and/or optical properties by the addition of chemical additives. Examples of properties that are developed or enhanced through the addition of chemical additives include but are not limited to dry strength, wet strength, softness, absorbency, opacity, brightness and color. During the papermaking process, chemical additives are commonly added to fiber slurries in the wet end, before the fibers are formed into a web, dewatered and dried. Traditionally, wet end additives are added to a fiber slurry that is between 0.5 and 5 percent consistency. The slurry may then be further diluted in the papermaking process before a final dilution at the fan pump to the ultimate forming consistency.

Wet end chemical addition has several advantages over topical spray, printing or size press chemical addition methods. For instance, wet end chemical addition provides a uniform distribution of chemical additives on the fiber surfaces. Additionally, wet end chemical addition allows a selected fiber fraction to be treated with a specific chemical additive in order to enhance the performance of the paper and/or the effectiveness of the chemical additive. Further, wet end chemical addition enables multiple chemistries to be added to a fiber slurry, either simultaneously or sequentially, prior to formation of the paper web.

One difficulty associated with wet end chemical addition is that the water soluble or water dispersible chemical additives are suspended in water and are not completely adsorbed onto the cellulosic fibers. To improve adsorption of wet end additives, chemical additives are often modified with functional groups to impart an electrical charge when in water. The electrokinetic attraction between charged additives and the anionically charged fiber surfaces aids in the deposition and retention of chemical additives onto the fibers. Nevertheless, the amount of chemical additive that can be retained in the wet end generally follows an adsorption curve exhibiting diminishing effectiveness, similar to that described by Langmuir. As a result, the adsorption of water soluble or water dispersible chemical additives may be significantly less than 100 percent, particularly when trying to achieve high chemical additive loading levels.

Consequently, at any chemical addition level, and particularly at high addition levels, only a fraction of the chemical additive is retained on the fiber surface. The remaining fraction of the chemical additive remains dissolved or dispersed in the suspending water phase. These unadsorbed chemical additives can cause a number of problems in the papermaking process. The exact nature of the chemical additive will determine the specific problems that may arise, but a partial list of problems that may result from unadsorbed chemical additives includes: foam, deposits, contamination of other fiber streams, poor fiber retention on the machine, compromised chemical layer purity in multilayer products, dissolved solids build-up in the water system, interactions with other process chemicals, felt or fabric plugging, excessive adhesion or release on dryer surfaces, physical property variability in the finished product, and the like.

Therefore, what is lacking and needed in the art is a method for applying adsorbable chemical additives, particularly a dye, onto cellulosic fiber surfaces in the wet end of the papermaking process such that the amount of unadsorbed chemical additives in the process water is reduced or eliminated. The method minimizes the associated manufacturing and finished product quality problems that would otherwise occur.

SUMMARY OF THE INVENTION

It has now been discovered that chemical additives can be adsorbed onto cellulosic papermaking fibers at high levels with a minimal amount of unadsorbed chemical additives present in the papermaking process water. This is accomplished by treating a fiber slurry with an excess of the chemical additive, allowing sufficient residence time for adsorption to occur, filtering the slurry to remove unadsorbed chemical additives, and redispersing the filtered pulp with fresh water. Because the filtrate from the thickening process contains unadsorbed chemical additive, it is not sent forward in the process with the chemically treated fibers. Rather, the filtrate may be sent to the sewer or reused in a processing step prior to the filtration step.

Hence in one aspect, the invention resides in a method for applying chemical additives to cellulosic fibers. The method comprises the steps of: creating a fiber slurry comprising water, cellulosic fibers, and an adsorbable chemical additive; dewatering the fiber slurry to remove unadsorbed chemical additive; and redispersing the fibers with fresh water. This method for processing cellulosic papermaking fibers enables chemical additives to be adsorbed by fibers while at the same time maintaining significantly lower levels of unadsorbed chemical additive in the water phase compared to traditional wet end chemical addition. Thus, higher concentrations of the chemical additive on the fiber relative to the process water can be achieved as compared to what has been possible with prior methods.

For purposes of the present invention, the term "cellulosic" refers to papermaking fibers comprising an amorphous carbohydrate polymer, in contrast to synthetic fibers. The term "adsorbable" is used herein to refer to a chemical additive that can be assimilated by the surface of a cellulosic fiber, in the absence of any chemical reaction involving the chemical additive and the cellulosic fiber. The term "unadsorbed" refers to any portion of the chemical additive that is not adsorbed by the fiber and thus remains suspended in the process water. The term "fresh water" is used herein to refer to water that is substantially free of the unadsorbed chemical additive. Most desirably, the fresh water is completely free of the chemical additive.

The fiber slurry is desirably dewatered to increase the consistency of the fiber slurry to about 20 percent or greater, and particularly to about 30 percent or greater, in order to remove the majority of the water containing the unadsorbed chemical additive. The fibers are thereafter redispersed, desirably to decrease the consistency of the fiber slurry to a level suitable for papermaking, to about 20 percent or less, and more particularly to about 5 percent or less, such as about 3 to about 5 percent.

The present method allows for the production of fiber furnishes that are useful for making paper products, and particularly layered paper products. Thus, another aspect of the invention resides in a fiber furnish that has a higher chemical additive loading than could otherwise be achieved in combination with the relatively low level of unadsorbed chemical additive in the water. This is because chemical additive loading via traditional wet end addition is often limited by the level of unadsorbed chemical and its associated processing difficulties such as foam, deposits, chemical interactions, felt plugging, excessive dryer adhesion or release or a variety of paper physical property control issues caused by the presence of unadsorbed chemical in the water.

In one embodiment, a fiber furnish of the present invention comprises water, cellulosic fibers, and an adsorbable chemical additive. The amount of chemical additive adsorbed onto the fibers is about 2 kilograms per metric ton or greater, and the amount of unadsorbed chemical additive in the water is between 0 and about 20 percent of the amount of chemical additive adsorbed onto the fibers. In particularly desirable embodiments, the amount of adsorbed chemical additive is about 3 kg/metric ton or greater, particularly about 4 kg/metric ton or greater, and more particularly about 5 kg/metric ton or greater. Moreover, the amount of unadsorbed chemical additive in the water is between 0 and about 15 percent, particularly between 0 and about 10 percent, and more particularly between 0 and about 7 percent, of the amount of adsorbed chemical additive.

When the chemical additive is a dye, the amount of dye adsorbed onto the fibers can vary from between about 0.01 to about 20 kg per metric ton. Preferably, the amount of dye adsorbed onto the fibers is from between about 0.05 to about 15 kg per metric ton. More preferably, the amount of dye adsorbed onto the fibers is from between about 0.05 to about 7.5 kg per metric ton. Even more preferably, the amount of dye adsorbed onto the fibers is from between about 0.05 to about 10 kg per metric ton. Most preferably, the amount of dye adsorbed onto the fibers is from between about 0.05 to about 2.0 kg per metric ton.

The amount of unadsorbed dye in the water can vary from between 0 and about 20 percent of the amount of dye adsorbed onto the fibers. More preferably, the amount of unadsorbed dye in the water can vary from between about 5 to about 20 percent of the amount of dye adsorbed onto the fibers. Moreover, the amount of unadsorbed dye in the water is from between 0 and about 15 percent, particularly from between 0 and about 10 percent, and more particularly, from between 0 and about 7 percent of the amount of unadsorbed dye.

Another aspect of the invention resides in a method for making chemically treated paper products. The method includes the steps of: creating a first fiber slurry containing water, cellulosic fibers, and an adsorbable dye, and creating a second fiber slurry that is substantially free of the adsorbable dye. The first fiber slurry is dewatered to remove unadsorbed dye before the fibers in the first fiber slurry are redispersed with fresh water. The first and second fiber slurries are then used to form a paper product using a layered headbox. The first fiber slurry is supplied to a first layer of the headbox and the second fiber slurry is supplied to a second layer of the headbox.

Another aspect of the invention resides in a method for making chemically treated paper products. The method comprises the steps of: creating a first fiber slurry comprising water, cellulosic fibers, and an adsorbable chemical additive; creating a second fiber slurry that is substantially free of the adsorbable chemical additive; dewatering the first fiber slurry to remove unadsorbed chemical additive; redispersing the fibers in the first fiber slurry with fresh water; and forming a paper product using a layered headbox, the first fiber slurry supplied to a first headbox layer and the second fiber slurry supplied to a second headbox layer.

In another embodiment, a method for making a paper product comprises the steps of: creating a fiber slurry comprising water, cellulosic fibers and a first adsorbable chemical additive; dewatering the fiber slurry to a consistency of about 20 percent or greater; passing the dewatered fiber slurry through a disperser to mechanically work the fibers; diluting the fiber slurry with fresh water that is substantially free of the first chemical additive to a consistency of about 5 percent or less; adding a second adsorbable chemical additive comprising a debonding agent or a softening agent to the fiber slurry; dewatering the fiber slurry to a consistency of about 20 percent or greater; diluting the fiber slurry with fresh water that is substantially free of the second chemical additive to a consistency of about 5 percent or less; and forming a paper product from the fiber slurry. The first chemical additive may comprise, for example, a bonding agent to decrease the amount of lint from the product.

The present invention is particularly useful for adding chemical additives such as softening agents and debonding agents to the outer layer furnishes in a three layer paper product. In particular tissue products, for example, the center layer is adapted to provide strength development and control. The present invention allows the softening agents and debonding agents to be applied to the outer layers while minimizing contamination of the center strength layer.

Hence, another aspect of the invention resides in paper products formed from fibers that have been chemically treated to minimize the amount of residual, unadsorbed chemical additives in the process water. These paper products exhibit high chemical "purity" on the fiber fraction that has been treated using the present method and offer the ability to achieve excellent chemical layer purity when using a stratified headbox and/or the ability to achieve fiber specific chemical treatment in papers made from blends of two or more fiber types. The term "paper" is used herein to broadly include writing, printing, wrapping, sanitary, and industrial papers, newsprint, linerboard, tissue, napkins, wipers, towels, or the like.

The chemical additives that can be used in conjunction with the present invention include: dry strength aids, wet strength aids, softening agents, debonding agents, absorbency aids, sizing agents, dyes, optical brighteners, chemical tracers, opacifiers, dryer adhesive chemicals, and the like. Additional forms of chemical additives may include: pigments, emollients, humectants, viricides, bactericides, buffers, waxes, fluoropolymers, odor control materials and deodorants, zeolites, perfumes, debonders, vegetable and mineral oils, humectants, sizing agents, superabsorbents, surfactants, moisturizers, UV blockers, antibiotic agents, lotions, fungicides, preservatives, aloe-vera extract, vitamin E, or the like. Suitable chemical additives are adsorbable by the cellulosic papermaking fibers and are water soluble or water dispersible.

The term "softening agent" refers to any chemical additive that can be incorporated into paper products such as tissue to provide improved tactile feel. These chemicals can also act as debonding agents or can act solely to improve the surface characteristics of tissue, such as by reducing the coefficient of friction between the tissue surface and the hand.

The term "debonding agent" refers to any chemical that can be incorporated into paper products such as tissue to prevent or disrupt interfiber or intrafiber hydrogen bonding. Depending on the nature of the chemical, debonding agents may also act as softening agents. In contrast, the term "bonding agent" refers to any chemical that can be incorporated into tissue to increase or enhance the level of interfiber or intrafiber bonding in the sheet. The increased bonding can be either ionic, Hydrogen or covalent in nature.

The term "dye" refers to any chemical that can be incorporated into paper products, such as bathroom tissue, facial tissue, paper towels and napkins, to impart a color. Depending on the nature of the chemical, dyes may be classified as acid dyes, basic dyes, direct dyes, cellulose reactive dyes or pigments. All classifications are suitable for use in conjunction with the present invention.

The term "water soluble" refers to solids or liquids that will form a solution in water, and the term "water dispersible" refers to solids or liquids of colloidal size or larger that can be dispersed into an aqueous medium.

The method for applying chemical additives to papermaking fibers may be used in a wide variety of papermaking operations, including wet pressing and creped or uncreped throughdrying operations. By way of illustration, various tissue making processes are disclosed in U.S. Pat. No. 5,667,636 issued Sep. 16, 1997 to S. A. Engel et al.; and U.S. Pat. No. 5,607,551 issued Mar. 4, 1997 to T. E. Farrington, Jr. et al.; which are incorporated herein by reference.

The method may also be used in alternative processes, including: chemically pre-treating pulp in a pulp mill before a dry lap machine or crumb baler; adding chemical additives in sequence to reduce interactions; removing chemical additives from a fiber slurry (neutralizing anionic components, sizing or softening formulations) after a chemical additive has been added to facilitate the removal process; or the like.

Many fiber types may be used for the present invention including hardwood or softwoods, straw, flax, milkweed seed floss fibers, abaca, hemp, kenaf, bagasse, cotton, reed, and the like. All known papermaking fibers may be used, including bleached and unbleached fibers, fibers of natural origin (including wood fiber and other cellulosic fibers, cellulose derivatives, and chemically stiffened or crosslinked fibers), some component portion of synthetic fibers (synthetic papermaking fibers include certain forms of fibers made from polypropylene, acrylic, aramids, acetates, and the like), virgin and recovered or recycled fibers, hardwood and softwood, and fibers that have been mechanically pulped (e.g., groundwood), chemically pulped (including but not limited to the kraft and sulfite pulping processes), thermomechanically pulped, chemithermomechanically pulped, and the like. Mixtures of any subset of the above mentioned or related fiber classes may be used. The fibers can be prepared in a multiplicity of ways known to be advantageous in the art. Useful methods of preparing fibers include dispersion to impart curl and improved drying properties, such as disclosed in U.S. Pat. No. 5,348,620 issued Sep. 20, 1994 and U.S. Pat. No. 5,501,768 issued Mar. 26, 1996, both to M. A. Hermans et al. and U.S. Pat. No. 5,656,132 issued Aug. 12, 1997 to Farrington, Jr. et al.

Drying should be considered a means of further improving the substantivity of the chemical treatment. The two generally accepted methods of drying include flash drying and can drying. Flash drying is most common with bleached, chemi-thermo-mechanical pulp (BCTMP).

A single headbox or a plurality of headboxes may be used. The headbox or headboxes may be stratified to permit production of a multilayered structure from a single headbox jet in the formation of a web. In particular embodiments, the web is produced with a stratified or layered headbox to preferentially deposit shorter fibers on one side of the web for improved softness, with relatively longer fibers on the other side of the web or in an interior layer of a web having three or more layers. The web is desirably formed on an endless loop of foraminous forming fabric which permits drainage of the liquid and partial dewatering of the web. Multiple embryonic webs from multiple headboxes may be couched or mechanically or chemically joined in the moist state to create a single web having multiple layers.

Numerous features and advantages of the present invention will appear from the following description. In the description, reference is made to the accompanying drawings which illustrate preferred embodiments of the invention. Such embodiments do not represent the full scope of the invention. Reference should therefore be made to the claims herein for interpreting the full scope of the invention.

The general object of this invention is to provide paper products and a method for applying chemical additives to cellulosic fibers. More particularly, this invention relates to a method for applying chemical additives to cellulosic fibers used to make bathroom tissue.

Another object of this invention if to provide a method of adding a dye to cellulosic fibers at a location separate and distinct from the paper making equipment.

A further object of this invention is to provide a method for applying one or more chemical additives to cellulosic fibers at a location where the unadsorbed chemical additives can be removed without contaminating process water.

Still another object of this invention is to provide a method of dying cellulosic fibers to alter the color of the fibers before they are directed to a paper making machine.

Still further, an object of this invention is to provide a method for applying a chemical additive to cellulosic fibers which is economical and efficient.

Others objects and advantages of the present invention will become more apparent to those skilled in the art in view of the following description and the accompanying drawings.

DETAILED DESCRIPTION OF THE DRAWINGS

Figure 1:
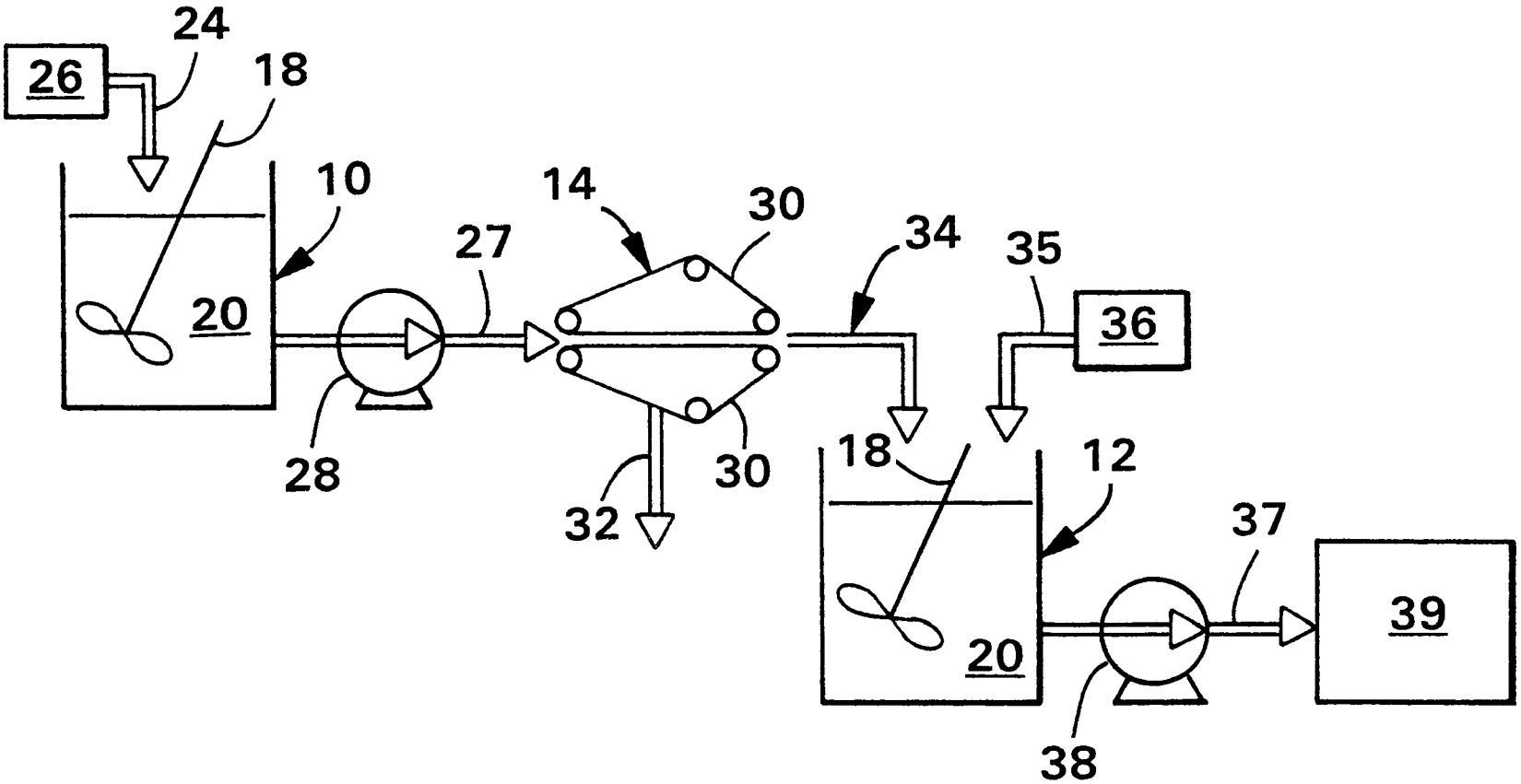
FIG. 1 depicts a schematic process flow diagram of a method according to the present invention for treating papermaking fibers with chemical additives.

The invention will now be described in greater detail with reference to the Figures. For simplicity, the various tensioning rolls schematically used to define the several fabric runs are shown but not numbered, and similar elements in different Figures have been given the same reference numeral. A variety of conventional papermaking apparatuses and operations can be used with respect to the stock preparation, headbox, forming fabrics, web transfers, creping and drying. Nevertheless, particular conventional components are illustrated for purposes of providing the context in which the various embodiments of the invention can be used.

FIG. 1 depicts stock preparation equipment used to apply chemical additives to papermaking fibers according to one embodiment of the present invention. The stock preparation equipment comprises a first stock chest 10, a second stock chest 12, and a dewatering device 14 operably disposed between the stock chests. Papermaking fibers and water are added to the first stock chest 10 to form a fiber slurry 20. The fiber slurry in the first stock chest desirably has a consistency of about 20 percent or lower, and particularly about 5 percent or lower, such as about 3 to about 5 percent. The fiber slurry in the first stock chest is desirably under agitation using a mixing blade, rotor, recirculation pump, or other suitable device 18 for mixing the fiber slurry.

One or more chemical additives 24 are supplied from a reservoir 26 and added to the fiber slurry 20 in the first stock chest 10. The amount of chemical additive 24 is suitably about 5 to about 20 kg./metric ton. In particular embodiments, the chemical additive comprises an imidazoline-based debonding agent and is added in an amount from about 7.5 to about 15 kg./metric ton. The fiber slurry and chemical additive are desirably allowed to remain together in the first stock chest under agitation for a residence time sufficient to allow the papermaking fibers to adsorb a substantial portion of the chemical additive 24. A residence time of about 15 to about 30 minutes, for instance, may be sufficient.

The chemical additive can be an imidazoline-based debonding agent that is added in an amount of from between about 2.0 to about 15 kg metric ton. The chemical additive 24 can also be a dye which is applied to the cellulosic fibers to alter the color of the fibers. In particular, the dye can be used in the treatment of mechanical pulps to reduce and/or eliminate the yellow color associated with pulp having a high lignin content. Violet dyes from the direct dye classification are particularly useful. A particular dye which works well on cellulosic fibers is Pergasol Violet BN and is available from Ciba-Geigy. For this particular dye, the amount adsorbed onto the fibers can vary from between about 0.01 to about 0.5 kilograms per metric ton. However, if one desires, the fibers could adsorb a larger amount of the dye, for example from between about 0.5 to about 20 kg per metric ton.

It should be noted that through mixing is required when adding an adsorbable chemical additive, for example, a dye. The time period required can be very short and only require a few seconds in many cases.

The fiber slurry 20 is thereafter transferred through suitable conduits 27 and a pump 28 to the dewatering device 14. In the illustrated embodiment, the dewatering device comprises a belt press 14, although alternative dewatering devices such as a centrifuge, a nip thickening device or the like may be used. The fiber slurry is injected between a pair of foraminous fabrics 30 such that press filtrate 32 is removed from the slurry. The press filtrate 32 comprises a portion of the process water along with unadsorbed chemical additives 24 in the water. The belt press 14 or other dewatering device suitably increases the fiber consistency of the slurry to about 20 percent or greater, and particularly about 30 percent or greater. The unadsorbed chemical additive can be removed from the process or used as dilution water in prior stock preparation steps, but importantly it is not sent forward with the chemically treated furnish.

The thickened fiber slurry 20 is then transported through conduits 34 to the second stock chest 12. The fiber slurry is then re-diluted with fresh water 35 from a suitable reservoir 36 and optionally agitated using a mixing device 18. The fiber consistency of the slurry is suitably decreased to about 20 percent or less, and particularly about 5 percent or less, such as about 3 to about 5 percent. The fiber slurry may then be removed from the second stock chest through suitable conduits 37 and a pump 38 for subsequent processing 39. Alternatively, the fiber slurry may be processed through the foregoing procedure again in an effort to further increase the chemical additive retention level.

In some instances, the treated fibers may not be used directly in a paper or tissue making process but instead can be dried and baled for later use. In this case, the chemically treated, thickened fiber slurry 20 can be pressed to a consistency of about 40 percent. The higher the consistency, the less free chemical and water is available to evaporate during drying. For practically reason, the minimum consistency of the fiber slurry 20 should not fall below 30 percent and the maximum consistency of the fiber slurry 20 should not exceed 50 percent when using a twin roll press. Other types of presses which could be used include: a screw press, a twin-wire press, as well as various other types of press machines used in pulp sheeting machines. After the fiber slurry 20 has been pressed, it can be dispersed using a fluffier device to separate clumps of fiber and then be dried using a flash drier before being baled.

Figure 2:
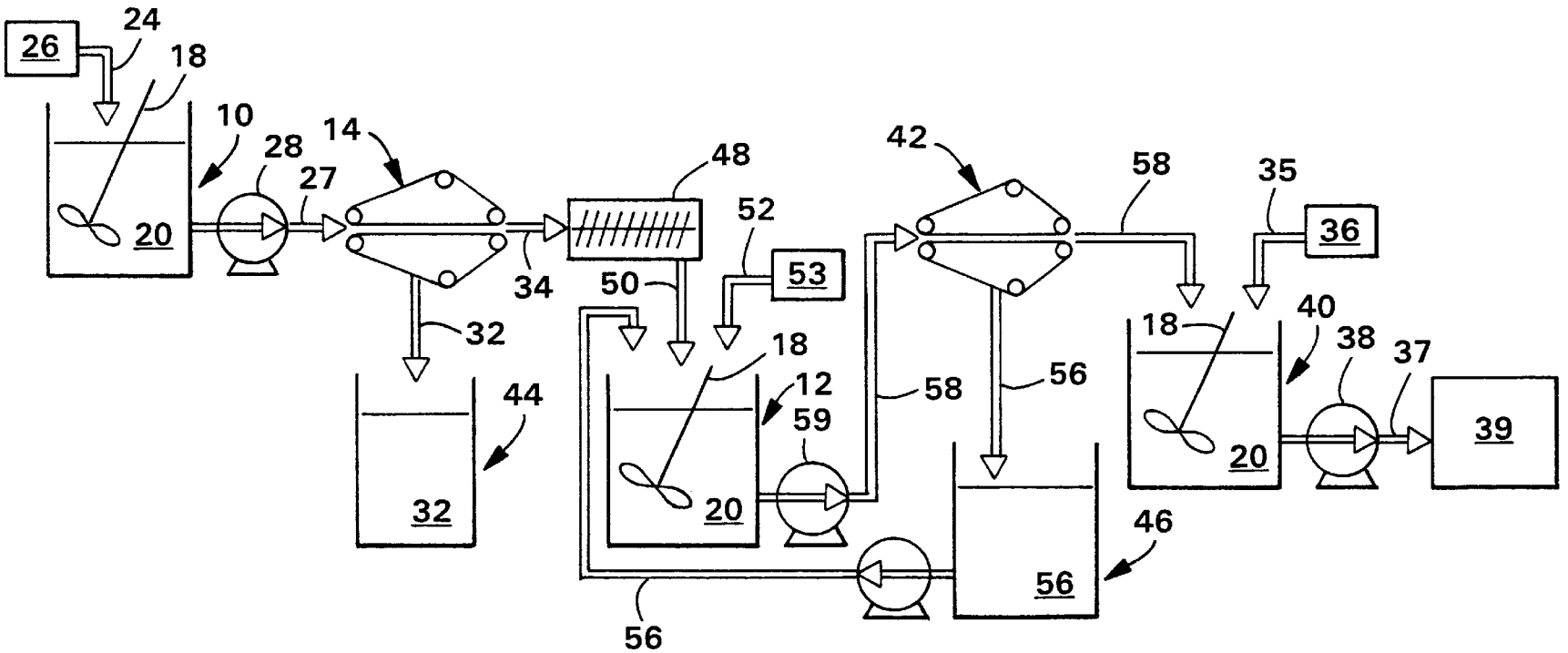
FIG. 2 depicts a schematic process flow diagram of a method according to the present invention for both treating papermaking fibers with chemical additives and mechanically treating the fibers using a disperser.

FIG. 2 depicts an alternative embodiment of the present invention in which stock preparation equipment is used to apply chemical additives to papermaking fibers and to mechanically treat the fibers. In general, the equipment comprises three stock chests 10, 12 and 40, two dewatering devices 14 and 42, two dilution water chests 44 and 46, and a disperser 48 for mechanically treating the papermaking fibers.

Papermaking fibers and water are added to the first stock chest 10 to form a fiber slurry 20. The fiber slurry in the first stock chest desirably has a consistency of about 20 percent or lower, and particularly about 5 percent or lower. One or more chemical additives 24 are supplied from a reservoir 26 and added to the fiber slurry 20 in the first stock chest 10 while under agitation 18. The first chemical additive added to the fiber slurry is desirably a cationic bonding agent which is used to control lint in the finished product. The first chemical additive is desirably not a softening agent or debonding agent that would reduce the efficiency of the disperser.

After a sufficient residence time, the fiber slurry is transferred through suitable conduits 27 and a pump 28 to a belt press 14 or other suitable dewatering device. Unadsorbed chemical additives in the water are removed with the press filtrate 32 during the pressing operation and stored in the first dilution water chest 44. The contents of the first dilution water chest may be used as either pulper make-up water or dilution water or may be discarded. The dewatering device 14 suitably increases the fiber consistency of the slurry to about 20 percent or greater, and particularly about 30 percent or greater.

The thickened fiber slurry 20 is then transported through suitable conduits 34 to the disperser 48 for mechanical treatment of the fibers. Dispersers suitable for use in the present method are disclosed in U.S. Pat. No. 5,348,620 issued Sep. 20, 1994 and U.S. Pat. No. 5,501,768 issued Mar. 26, 1996, both to M. A. Hermans et al., which are incorporated herein by reference.

After dispersing, the fiber slurry is transported via conduits 50 to the second stock chest 12. A second chemical additive or second group of chemical additives 52 are supplied from a reservoir 53 and added to the fiber slurry 20 in the second stock chest 12 while under agitation 18. Additionally, the fiber slurry may optionally be diluted with filtrate 56 from a source described hereinafter. The fiber consistency of the slurry is suitably decreased to about 20 percent or lower, and particularly about 5 percent or lower, such as about 3 to about 5 percent. In particular embodiments, the second chemical additive 52 comprises a softening agent and/or a debonding agent, and the fiber slurry is not subjected to high shear refining forces such as those generated in a disperser once the softening and/or debonding agent is added to the fiber slurry.

After a sufficient residence time to permit adsorption of the second chemical additive, the fiber slurry 20 is transferred from the second stock chest 12 through suitable conduits 58 and a pump 59 to the second dewatering device 42. Unadsorbed portions of the second chemical additive 52 in the water are removed with the press filtrate 56 during the pressing operation and stored in the second dilution water chest 46. The contents of the second dilution water chest may be added to the second stock chest 12 as described above or may be discarded. The second dewatering device 42 suitably increases the fiber consistency of the slurry to about 20 percent or greater, and particularly about 30 percent or greater.

The thickened fiber slurry 20 is then transported through conduits 58 to the third stock chest 40. The fiber slurry is then re-diluted with fresh water 35 from a suitable reservoir 36 and optionally agitated using a mixing device 18. The fiber consistency of the slurry is suitably decreased to about 20 percent or lower, and particularly about 5 percent or lower, such as about 3 to about 5 percent. The fiber slurry may then be removed from the third stock chest through suitable conduits 37 and a pump 38 for subsequent processing 39. Alternatively, the fiber slurry may be returned to the second stock chest 12 for repeated application of the second chemical additive 52.

Figure 3:
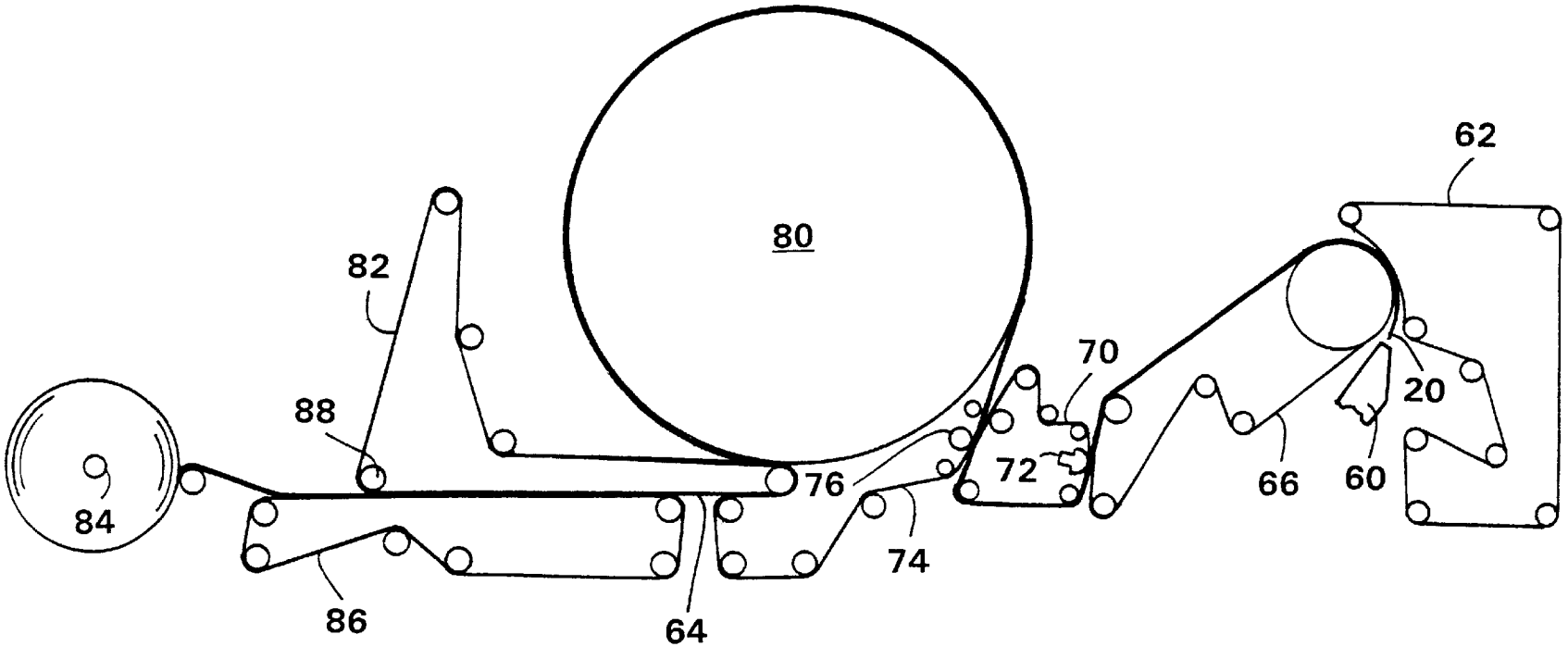
FIG. 3 depicts a schematic process flow diagram for a method of making an uncreped tissue sheet.

One suitable process 39 for making paper products from the fiber slurries 20 of FIGS. 1 or 2 is the uncreped throughdrying method depicted in FIG. 3. The uncreped throughdrying method is also disclosed in U.S. Pat. No. 5,656,132 issued Aug. 12, 1997 to Farrington, Jr. et al., which is incorporated herein by reference. A twin wire former having a layered papermaking headbox 60 injects or deposits a stream from the fiber slurry 20 onto the forming fabric 62 to form a cellulosic web 64. The web is then transferred to fabric 66, which serves to support and carry the newly-formed wet web downstream in the process as the web is partially dewatered to a consistency of about 10 dry weight percent. Additional dewatering of the wet web can be carried out, such as by vacuum suction, while the wet web is supported by the forming fabric.

The wet web is then transferred from the forming fabric 66 to a transfer fabric 70 traveling at a slower speed than the forming fabric in order to impart increased MD stretch into the web. A kiss transfer is carried out to avoid compression of the wet web, preferably with the assistance of a vacuum shoe 72. The transfer fabric can be a fabric having impression knuckles or it can be a smoother fabric such as Asten 934, 937, 939, 959 or Albany 94M. If the transfer fabric is of the impression knuckle type described herein, it can be utilized to impart some of the same properties as the throughdrying fabric and can enhance the effect when coupled with a throughdrying fabric also having the impression knuckles. When a transfer fabric having impression knuckles is used to achieve the desired CD stretch properties, it provides the flexibility to optionally use a different throughdrying fabric, such as one that has a decorative weave pattern, to provide additional desirable properties not otherwise attainable.

The web is then transferred from the transfer fabric to a throughdrying fabric 74 with the aid of a vacuum transfer roll 76 or a vacuum transfer shoe. The throughdrying fabric can be traveling at about the same speed or a different speed relative to the transfer fabric. If desired, the throughdrying fabric can be run at a slower speed to further enhance MD stretch. Transfer is preferably carried out with vacuum assistance to ensure deformation of the sheet to conform to the throughdrying fabric, thus yielding desired bulk, flexibility, CD stretch and appearance. The throughdrying fabric is preferably of the impression knuckle type.

The level of vacuum used for the web transfers can be from about 3 to about 15 inches (about 75 to about 380 millimeters) of mercury, preferably about 10 to about 15 inches (about 254 to about 380 millimeters) of mercury. The vacuum shoe (negative pressure) can be supplemented or replaced by the use of positive pressure from the opposite side of the web to blow the web onto the next fabric in addition to or as a replacement for sucking it onto the next fabric with vacuum. Also, a vacuum roll or rolls can be used to replace the vacuum shoe(s).

Specific embodiments and modes of operation relating to the forming fabric, transfer fabric, rush transfer, transfer shoes, fabric positioning, and vacuum levels are disclosed in U.S. Pat. No. 5,667,636 issued Sep. 16, 1997 to S. A. Engel et al. and U.S. Pat. No. 5,607,551 issued Mar. 4, 1997 to T. E. Farrington, Jr. et al., which are incorporated herein by reference.

While supported by the throughdrying fabric, the web is final dried to a consistency of about 94 percent or greater by the throughdryer 80 and thereafter transferred to a carrier fabric 82. The dried basesheet is transported to the reel 84 using carrier fabric 82 and an optional carrier fabric 86. An optional pressurized turning roll 88 can be used to facilitate transfer of the web from carrier fabric 82 to fabric 86. Suitable carrier fabrics for this purpose are Albany International 84M or 94M and Asten 959 or 937, all of which are relatively smooth fabrics having a fine pattern. The roll of tissue may then be calendered, slit, surface treated with emollient or softening agents, embossed, or the like in subsequent operations to produce the final product form.

EXAMPLES

The following examples serve to illustrate possible approaches pertaining to the present invention. The particular amounts, proportions, compositions and parameters are meant to be exemplary, and are not intended to specifically limit the scope of the invention.

Example 1 (Comparative)

For this example, a softening/debonding agent was added during production of a multi-fiber, three-layer tissue using a conventional, stuffbox chemical addition method. The furnish used for the outer two layers comprised 70% Eucalyptus fibers, 29% tissue broke and 1% recycled fiber corestock. The outer layer furnish components were blended at the pulper. After repulping, the furnish was transferred to a chest and treated with a bonding agent, Parez 631NC which is commercially available from Cytec Industries, Inc., at a dosage of 1 kg./metric ton. After allowing the slurry to mix for 20 minutes, the furnish was thickened to greater than 30% consistency using a dewatering press and treated in a disperser to impart curl to the fibers. The disperser was operated with a power input of 80 kilowatts and an exit stock temperature of about 180° F. After dispersing, the fibers were stored in a high density chest until needed during tissue manufacturing.

At the time of manufacturing, the outer layer furnish, consisting of the dispersed Eucalyptus/broke/corestock blend, was diluted to 3.5% consistency in a chest using the filtrate from the earlier thickening process. A softening/debonding agent, C-6092 which is commercially available from Witco Corp., was added to this furnish at a rate of 6.5 kg./metric ton at the machine chest stuffbox recirculation loop. This stuffbox feeds the fan pumps for both outer layers of a three-layer tissue sheet.

The center layer furnish comprised 100% northern bleached softwood kraft fibers. This furnish was refined at an energy input of 2 horsepower days/metric ton for dry strength development. Parez 631NC was also added to this furnish at a dosage of 5.8 kg./metric ton to achieve wet tensile strength control. Dry strength control was achieved by varying the ratio of center layer to outer layer furnish.

A one-ply, uncreped through air dried tissue was produced using a pilot tissue machine. This same tissue machine was used for Examples 1–4. The machine contains a 3 layer headbox, of which the outer layers contained the same furnish (70% Eucalyptus, 29% broke, 1% corestock) and the center layer was 100% softwood fiber. The resulting three-layered sheet structure was formed on a twin-wire, suction form roll, former. The speed of the forming fabrics was 2250 feet per minute (fpm). The newly-formed web was then dewatered to a consistency of about 20–27 percent using vacuum suction from below the forming fabric before being transferred to the transfer fabric, which was traveling 1800 feet per minute (25% rush transfer). A vacuum shoe pulling about 10 inches of mercury vacuum was used to transfer the web to the transfer fabric. The web was then transferred to a throughdrying fabric traveling at a speed of about 1800 fpm. The web was carried over a pair of Honeycomb throughdryers operating at temperatures of about 325° F. and dried to final dryness of about 94–98 percent consistency.

The air dry basis weight of the sheet was 27.5 gsm. The final fiber ratio in the sheet was 32% softwood fiber (in center layer) and 68% Eucalyptus/broke/corestock blend (outer layers). The final strength of the tissue was 800 grams per 3 inch width (geometric mean tensile strength).

Example 2

For this example, the improved chemical addition method shown in FIG. 1 was used to treat a furnish with a softening/debonding agent. The treated furnish was then used as the outer layer furnish in a multi-fiber, three-layered tissue structure. Because the improved chemical addition method removes most non-retained softening/debonding agent from the water phase during tissue forming, the resultant product can be produced at equivalent tensile strength, higher softener/debonder content and a lower softwood fiber content than a tissue made with the identical softening agent using the conventional chemical addition method described in Example 1.

In Example 2, the furnish used for the outer two layers comprised 70% Eucalyptus fibers, 29% tissue broke and 1% recycled fiber corestock. During the stock preparation phase, the outer layer furnish was blended during repulping and placed in a stock chest at 3.5% consistency. The furnish was then treated with a bonding agent, Parez 631NC from Cytec Industries, Inc., at a dosage of 1 kg./metric ton. After allowing the slurry to mix for 20 minutes, a softening/debonding agent, C-6092 from Witco Corp., was added at a dosage of 7.5 kg. of active chemical/metric ton of fiber. After an additional 20 minutes of mixing time, the slurry was dewatered using a belt press to approximately 32% consistency. The filtrate from the dewatering process was used as pulper make-up water for subsequent batches but not sent forward in the stock preparation or tissuemaking process. The thickened pulp was then passed through a disperser with a power input of 80 kilowatts and a stock temperature of about 180° F. to impart curl to the fibers. After the dispersing operation, the stock was placed in a high density storage chest until needed during tissue manufacturing.

A one-ply, uncreped, through air dried tissue was made using a three layered headbox, as described in Example 1. The furnish for the outer two layers comprised the chemically treated 32% consistency Eucalyptus/broke/corestock furnish blend, which had been re-diluted to 3% consistency with fresh water in a chest under agitation. The center layer consisted of 100% softwood fibers refined at an energy input of 2 horsepower days/metric ton, to which 5.8 kg./metric ton of Parez 631NC was added for wet strength control. Finished product dry strength control was achieved by adjusting the ratio of center layer and outer layer furnish in the sheet.

The air dry basis weight of the sheet was 27.5 gsm. The final fiber ratio in the sheet was 17% softwood fiber (in center layer) and 83% Eucalyptus/broke/corestock blend (outer layers). The final strength of the tissue was 802 grams per 3 inch width (geometric mean tensile strength).

Example 3

For this example, the improved chemical addition method shown in FIG. 2 was used to first treat a furnish with a bonding agent, mechanically modify the fibers using a disperser, and then treat the furnish with a softening/debonding agent. The chemically treated furnish was used as one furnish in a multi-fiber, three-layered tissue structure. Because the improved chemical addition method removes most non-retained softening/debonding agent from the water phase during tissue forming, the resultant product was much stronger (at equal fiber composition) than a tissue made with similar softening agent using the conventional chemical addition method described in Example 1. In addition, because the softener/debonder is not present on the furnish during the dispersing operation, there is a more efficient transfer of energy to the fibers. This results in a higher level of debonding than demonstrated in Example 2 due to the fiber curl properties imparted during dispersing.

In Example 3, the furnish used for the outer two layers comprised 70% Eucalyptus fibers, 29% tissue broke and 1% recycled fiber corestock. During the stock preparation phase, the outer layer furnish was blended during repulping and placed in a stock chest at 3.5% consistency. The furnish was then treated with a bonding agent, Parez 631NC from Cytec Industries, Inc., at a dosage of 1 kg./metric ton. After allowing the slurry to mix for 20 minutes, the furnish was dewatered using a belt thickening press to greater than 30% consistency. The thickened pulp was then passed through a disperser with a power input of 80 kilowatts and a stock temperature of about 180° F. to impart curl to the fibers. The high consistency, dispersed pulp was then stored in a chest until sufficient quantities could be produced.

In order to treat the furnish with a second chemical additive, the high consistency pulp was then diluted to 3.5% consistency with a combination of fresh water and thickener filtrate (containing unadsorbed softening/debonding agent, as shown in FIG. 2). The furnish was next treated with 7.5 kg./metric ton of a softening/debonding agent, C-6092 from Witco Corp., and allowed to mix for 20 minutes. The furnish was then dewatered using a belt press to approximately 32% consistency. The filtrate from the dewatering process was used as partial dilution water for the high consistency stock dilution step, as previously mentioned. After the second thickening operation, the stock was placed in a high density storage chest until needed during tissue manufacturing.

A one-ply, uncreped, through air dried tissue was made using a three layered headbox, as described in Example 1. The furnish for the outer two layers comprised the chemically treated 32% consistency Eucalyptus/broke/corestock furnish blend, which had been re-diluted to 3% consistency with fresh water in a chest under agitation. The center layer comprised 100% softwood fibers refined at an energy input of 2 horsepower days/metric ton, to which 5.8 kg./metric ton of Parez 631NC was added for wet strength control. Finished product dry strength control was achieved by adjusting the ratio of center layer and outer layer furnish in the sheet.

The air dry basis weight of the sheet was 27.5 gsm. The final fiber ratio in the sheet was 24% softwood fiber (in center layer) and 76% Eucalyptus/broke/corestock blend (outer layers). The final strength of the tissue was 806 grams per 3 inch width (geometric mean tensile strength).

Example 4

This example is similar to Example 3, except that 15 kg./metric ton of C-6092 softener/ debonder was added to the outer layer furnish (instead of 7.5 kg./metric ton in Example 3). Because the improved chemical addition method has removed most non-retained softening/ debonding agent from the water phase during tissue formation, the resultant product contains 55% more softening/debonding agent than the product described in Example 1, at equivalent tensile strength and fiber composition.

The stock preparation and tissue manufacturing procedures were identical to Example 3. The air dry basis weight of the sheet was 27.5 gsm. The final fiber ratio in the sheet was 31% softwood fiber (in center layer) and 69% Eucalyptus/broke/corestock blend (outer layers). The final strength of the tissue was 795 grams per 3 inch width (geometric mean tensile strength).

The results shown in Table 1 below indicate that a layered tissue sheet can be made with a geometric mean tensile strength of about 800 grams per 3 inch width (795 grams per 3 inch width), under the processing conditions described in Example 4, that contains 31% softwood fiber and 5.9 kg./metric ton of retained C-6092 softener/debonder by using the improved chemical addition method. When using the conventional chemical addition method described in Example 1, and otherwise identical manufacturing conditions, a layered tissue sheet with a geometric mean tensile strength of 800 g./3" width contains 32% softwood fiber but only 3.8 kg./metric ton of retained C-6092 softener/ debonder. The reason for this difference in retained C-6092 at equivalent tissue strength, it is hypothesized, is because the debonding characteristic of the unadsorbed C-6092 in the conventional chemical addition method compromises the strength development of the softwood fibers in the center layer. As a result, more softwood fiber is needed to achieve the same finished product tensile strength.

By using the improved chemical addition method, tissue fiber/chemistry combinations can be produced at target strength levels that could not otherwise be made using conventional chemical addition methods. In Examples 2–4, the tissues were manufactured with generally constant basis weight and strength by adjusting the relative amounts of softwood and hardwood. Of course, various alternatives are possible such as maintaining generally constant strength and softwood/hardwood proportion and adjusting the basis weight.

TABLE 1

Examples 1–4

| Example | Strength (g./3") | % Center Layer | % Outer Layer | Debonder Add-on | Debonder Retained |
|---|---|---|---|---|---|
| 1 | 800 | 32 | 68 | 4.4 | 3.8 |
| 2 | 802 | 17 | 83 | 6.2 | 4.6 |
| 3 | 806 | 24 | 76 | 5.7 | 3.8 |
| 4 | 795 | 31 | 69 | 10.4 | 5.9 |

In Table 1, "Strength" refers to the geometric mean tensile strength which is calculated for purposes of the present invention according to the formula: $\sqrt{[(\text{MDtensile})(\text{CDtensile})]}$. The "MD tensile" strength of a tissue sample is the conventional measure, known to those skilled in the art, of load per sample width at the point of failure when a tissue web is stressed in the machine direction. Likewise, "CD tensile" strength is the analogous measure taken in the cross-machine direction. MD and CD tensile strength are measured using an Instron tensile tester using a 3-inch jaw width, a jaw span of 4 inches, and a crosshead speed of 10 inches per minute. Prior to testing the sample is maintained under TAPPI conditions (73° F., 50% relative humidity) for 4 hours before testing. Tensile strength is reported in units of grams per 3 inch width (at the failure point).

The % Center Layer and % Outer Layer refer to the weight percent of fibers in the appropriate layers.

The Debonder Add-on reflects the chemical additive that is added to the furnish in kg./metric ton of the entire sheet. This is calculated based on the add-on level to the outer layer furnish and the amount of the outer layer furnish in the final sheet.

The Debonder Retained reflects the amount of chemical additive adsorbed onto the tissue. The Debonder Retained can be determined using the following procedure suitable for imidazoline-based chemical additives such as Witco C-6092 that are added to the tissue. The procedure references the percent add-on, which has been converted to kg./metric ton (multiplied by 10) in Table 1. In general, a sample of the tissue is weighed and extracted in a sealed container for a given amount time on a flatbed shaker at ambient conditions. After the extraction, the tissue is removed and the extract allowed to settle. The extract is then analyzed by ultraviolet spectrometer. After the percent extracted is calculated, the add-on percent can be determined by reference to an add-on correlation curve that is generated as described below.

The following equipment and chemicals are used: pipets, 1, 3, 5, 10 and 100 mL; volumetric flasks, 100 and 1000 mL; sealed containers, e.g. specimen cups; a flatbed shaker, such as an orbital flatbed shaker (Lab Line Orbital Shaker Model No. 3590, Lab Line Instruments, Inc.); an ultraviolet spectrometer (Hewlett Packard Model 8451A Diode Array Spectrophotometer, Hewlett Packard); methanol, reagent grade; imidazoline, standard such as Witco C-6092; beakers, 30 mL; and control tissues that differ from the tissue being tested only by the absence of the chemical additive being tested.

A stock standard imidazoline solution (1000 ppm active) is prepared: Weigh 0.1250 grams of C-6092 (80% active)

into a 30 mL beaker; transfer quantitatively to a 100 mL flask with methanol; and dilute to mark with methanol and invert several times.

Standard imidazoline solutions (10, 30, 50, 100 ppm) are prepared: Into four 100 mL volumetric flasks, add 1, 3, 5, and 10 mL of the 1000 ppm stock standard imidazoline solution; and dilute to marks with methanol. The standards are 10, 30, 50 and 100 ppm, respectively.

Generate a Standard Solution Curve: With the UV spectrophotometer set at 238 nm wavelength, reference the instrument using a methanol sample. Read the absorptance of the standard solutions (10, 30, 50 and 100 ppm), then plot a curve of the concentration versus absorptance. Generate a first-order equation fit of the data.

Spiking solutions (1000 and 5000ppm) are prepared: Weigh out 1.250 and 6.250 grams of C-6092 into 50 ml beakers; transfer quantitatively to a 1000 ml flask with distilled water; shake well and allow to dissolve before diluting to mark. If excessive foaming occurs, fill to the stem of the flask and add a small amount of methanol to eliminate the foam and dilute to mark then invert several times. This makes a 1000 ppm and 5000 ppm spiking solutions.

Generate an Add-On Correlation Curve: A minimum of three replicates should be performed for each level of add-on and for blanks. There should be at least four levels of add-on to generate a curve. Spiking solutions should be made with distilled water, so that the spiked sample can be dried in a 60 degree Celsius oven.

Weigh out 5.00 grams of control tissue into a specimen container. For four levels, three replicates, and blanks, prepare 15 samples. A typical curve would be 0.1, 0.3, 0.8, nd 1.0% C-6092 add-on based on the weight of the tissue.

Spike samples with spiking solution and dry for 48 hours in a 60 degree Celsius ven. Use volumetric pipettes. Example:

| | Volume of Spiking Solution for 5.00 gram tissue | |
|---|---|---|
| Add-on Level | 1000 ppm | 5000 ppm |
| Blank | 0 mL | 0 mL |
| 0.1% | 5 mL | — |
| 0.3% | 15 mL | — |
| 0.8% | — | 8 mL |
| 1.0% | — | 10 mL |

Add 100 mL of methanol using a pipet and seal the containers. Place in a flatbed shaker and extract for ½ hour. Remove tissue and allow the extract to settle. With a transfer pipette, remove supernatant and fill a spectrophotometer cuvette. Measure the absorptance at 238 nm wavelength using the UV spectrometer. A 1 to 10 dilution may be required to stay within the standard curve. Blanks should be read with and without this dilution. Subtract the mean absorptance readings from the blanks. Use the 1/10 dilution blank readings for 1/10 dilution samples and no dilution blank readings for the no dilution samples.

The percent extracted is then calculated from the ppm reading from the standard curve (imidazoline) as follows:

% Extracted (no dilution)=ppm reading×0.1×100/5000.

% Extracted (1/10 dilution)=ppm reading×0.1×10×100/5000.

Construct an Add-on Correlation curve with the percent extracted values (y-axis) versus the corresponding add-on level (x-axis). Select the best fitting curve (first or second order).

Sample Analysis: Weigh out 5.00 grams sample in a specimen container and add 100 mL of methanol. Place on the flatbed shaker and extract for ½ hour. Remove the tissue and allow to settle. Read the extracts at 238 nm wavelength and subtract the mean blank absorptance reading. Calculate the ppm from the standard curve and then calculate the percent extracted value. Using the Add-on correlation curve, calculate the percent add-on with the percent extracted value.

Imidazoline has a peak absorptance at 238 nm wavelength. While blank tissue extracts do not have this peak absorptance at 238 nm, it does have some absorptance that interferes with the quantitation. Blanks are quite reproducible and can be subtracted for the determination. It is important that the weight of the sample, volume of methanol, and the extraction time be kept constant. An add-on correlation curve should be generated for different tissue samples, because various chemicals used in the tissue process can affect the binding of the imidazoline thus affecting the recovery. Percent add-on also affects the percent recovery; using various levels of add-on in constructing the correlation curve helps to determine the add-on value.

Example 5

To better illustrate the ability for the improved chemical addition method to remove unadsorbed chemicals from the furnish of a papermaking process, a laboratory scale experiment was conducted. The objective of this experiment was to demonstrate how much unadsorbed chemical is present in systems that do not use the improved addition method and compare this to systems in which the same amount of chemical is added using the improved method. The furnish used in this experiment was 100% Eucalyptus fibers. The chemical additive used was C-6092, a softener/debonder commercially available from Witco Corp. The addition levels were 0.5% and 1.0% active debonder on dry fiber.

0.5% Addition Experiment: Step 1

During the experiment, 1800 grams of a 2.5% consistency fiber slurry (45 g. dry fiber) were agitated using a mechanical mixer. To the fiber slurry under agitation, the appropriate amount of C-6092 chemical was added in the form of a 1% active solution. The volume of 1% active C-6092 required for a 0.5% loading was 22.5 ml. After agitation for 15 minutes, 600 ml of slurry was removed and spread out on a plate to dry at room temperature under a hood. This sample will be referred to as 1A.

Step 2

The remaining 1200 grams of slurry were filtered using a Whatman 4 filter paper and Buchner funnel apparatus. This filtration step simulates the dewatering step of the improved chemical addition method shown in FIG. 1. The filter pad (at approximately 25% consistency) was split into two sections of approximately equal mass. One section was placed in the hood to dry at room temperature. This sample will be referred to as 2A.

Step 3

The other half of the filter pad (approximately 600 g.) was redispersed to 2.5% consistency using distilled water. The slurry was mechanically agitated for 15 minutes and then filtered using a Whatman 4 filter paper and Buchner funnel apparatus. This filtration step simulates the dewatering that occurs in the forming and vacuum dewatering zones of a tissue machine. The filter pad was placed in a hood to dry at room temperature. This sample will be referred to as 3A.

1.0% Addition Experiment

Steps 1–3 were repeated using a 1.0% addition level of C-6092. The corresponding samples were coded 1B, 2B and 3B.

All samples were analyzed for C-6092 content using a methanol extraction followed by UV spectroscopic analysis at 238 nm and comparison of the absorptance to a known calibration curve. The results are shown in the table below:

| | Sample No. | | | | | |
|---|---|---|---|---|---|---|
| | 1A | 2A | 3A | 1B | 2B | 3B |
| C-6092 Content (%) | 0.51 | 0.30 | 0.28 | 1.05 | 0.73 | 0.68 |

The results demonstrate the impact of using the improved chemical addition method on reducing the amount of unadsorbed debonder in the furnish. Comparing the C-6092 content of samples 1A and 2A shows that 41% of the chemical is not retained sufficiently onto the fibers and is removed during dewatering. If the conventional stuffbox chemical addition method is used this unadsorbed chemical is free in the furnish to contaminate other fiber streams and cause the processing problems previously described. Comparing the C-6092 content of samples 2A and 3A, however, shows that only an additional 6% of the retained C-6092 is removed during a second dewatering step, which simulates sheet formation on a tissue machine.

When the C-6092 content of the 1B, 2B and 3B samples are compared it can be shown that 30% of the original 1.0% chemical loading is removed during the first dewatering step, but only an additional 7% of the retained C-6092 is removed during the second dewatering step.

It is believed that this simulation of the improved chemical addition method demonstrates the ability to significantly reduce the amount of unadsorbed chemical additive in the water of a paper manufacturing process while maintaining high chemical retention levels on the fiber fraction.

The foregoing detailed description has been for the purpose of illustration. Thus, a number of modifications and changes may be made without departing from the spirit and scope of the present invention. For instance, alternative or optional features described as part of one embodiment can be used to yield another embodiment. Additionally, two named components could represent portions of the same structure. Further, various alternative process and equipment arrangements may be employed, particularly with respect to the stock preparation, headbox, forming fabrics, web transfers, creping and drying. Therefore, the invention should not be limited by the specific embodiments described, but only by the claims and all equivalents thereto.

We claim:

1. A method comprising:

creating a fiber slurry comprising water, cellulosic fibers, and an adsorbable chemical additive, wherein the chemical additive is added to said slurry of water and cellulosic fibers in an amount of about 5 kilograms per metric ton or greater;

dewatering the fiber slurry to remove unadsorbed chemical additive; and redispersing the fibers with fresh water.

2. A method comprising:

creating a first fiber slurry comprising water, cellulosic fibers, and an adsorbable chemical additive;

creating a second fiber slurry that is substantially free of the adsorbable chemical additive;

dewatering the first fiber slurry to remove unadsorbed chemical additive;

redispersing the fibers in the first fiber slurry with fresh water; and forming a paper product using a layered headbox, the first fiber slurry supplied to a first headbox layer and the second fiber slurry supplied to a second headbox layer.

3. The method of claim 1, wherein creating a fiber slurry comprises adding the adsorbable chemical additive to an aqueous solution comprising the water and cellulosic fibers.

4. The method of claim 2, wherein the chemical additive is added to a slurry of water and cellulosic fibers in an amount of about 5 kilograms per metric ton or greater.

5. The method of claim 1 or 2, wherein dewatering increases the consistency of the fiber slurry to about 30 percent or greater.

6. The method of claim 1 or 2, wherein redispersing the fibers decreases the consistency of the fiber slurry to about 5 percent or lower.

7. The method of claim 1 or 2, further comprising maintaining the removed unadsorbed chemical additive separate from the fiber slurry.

8. The method of claim 1 or 2, wherein the fresh water is completely free of unadsorbed chemical additive.

9. The method of claim 1 or 2, wherein sufficient residence time is provided after the chemical additive is added to allow for adsorption.

10. The method of claim 1 or 2, wherein the removed unadsorbed chemical additive is reused in a processing step prior to dewatering the fiber slurry.

11. The method of claim 1 or 2, wherein the adsorbable chemical additive comprises a debonding agent.

12. The method of claim 1 or 2, wherein the adsorbable chemical additive comprises a softening agent.

13. The method of claim 1 or 2, wherein the chemical additive comprises a debonding agent or softening agent and the fiber slurry is not subjected to high shear refining forces once the chemical additive is added to the fiber slurry.

14. The method of claim 1 or 2, wherein the redispersed fiber slurry is treated with a second adsorbable chemical additive, dewatered a second time to remove unadsorbed chemical additives and redispersed a second time.

15. The method of claim 14, wherein the second chemical additive comprises a softening agent.

16. The method of claim 14, wherein the second chemical additive comprises a debonding agent.

17. The method of claim 1, further comprising forming a paper product comprising a plurality of layers, with one but not all of the layers being formed from the fiber slurry containing the adsorbable chemical additive.

18. A method comprising:

creating a fiber slurry comprising water, cellulosic fibers and a first adsorbable chemical additive;

dewatering the fiber slurry to a consistency of about 20 percent or greater;

passing the dewatered fiber slurry through a disperser to mechanically work the fibers;

diluting the fiber slurry with fresh water that is substantially free of the first chemical additive to a consistency of about 5 percent or less;

adding a second adsorbable chemical additive comprising a debonding agent or a softening agent to the fiber slurry;

dewatering the fiber slurry to a consistency of about 20 percent or greater;

diluting the fiber slurry with fresh water that is substantially free of the second chemical additive to a consistency of about 5 percent or less; and forming a paper product from the fiber slurry.

19. The method of claim 18, wherein the first chemical additive comprises a bonding agent.

20. A fiber furnish produced using the method described in claim 1, wherein the amount of chemical additive adsorbed onto the fibers is about 2 kilograms per metric ton or greater, and the amount of unadsorbed chemical additive in the water is between 0 and about 20 percent of the amount of chemical additive adsorbed onto the fibers.

21. A fiber furnish comprising water, cellulosic fibers, and an adsorbable chemical additive, wherein the amount of chemical additive adsorbed onto the fibers is about 2 kilograms per metric ton or greater, and the amount of unadsorbed chemical additive in the water is between 0 and about 20 percent of the amount of chemical additive adsorbed onto the fibers.

22. The fiber furnish of claim 20 or 21, wherein the amount of chemical additive adsorbed onto the fibers is about 3 kilograms per metric ton or greater.

23. The fiber furnish of claim 22, wherein the amount of chemical additive adsorbed onto the fibers is about 4 kilograms per metric ton or greater.

24. The fiber furnish of claim 22, wherein the amount of chemical additive adsorbed onto the fibers is about 5 kilograms per metric ton or greater.

25. The fiber furnish of claim 20 or 21, wherein the amount of unadsorbed chemical additive in the water is between 0 and about 15 percent of the amount of chemical additive adsorbed onto the fibers.

26. The fiber furnish of claim 25, wherein the amount of unadsorbed chemical additive in the water is between 0 and about 10 percent of the amount of chemical additive adsorbed onto the fibers.

27. The fiber furnish of claim 25, wherein the amount of unadsorbed chemical additive in the water is between 0 and about 7 percent of the amount of chemical additive adsorbed onto the fibers.

28. The furnish of claim 20 or 21, wherein the chemical additive is selected from the group comprising softening agents, debonding agents, dry strength agents, wet strength agents and opacifying agents.

29. A method for applying a dye to cellulosic fibers, said method comprising the steps of:

a) creating a fiber slurry of water, cellulosic fibers, and an adsorbable dye, said dye being adsorbed onto said cellulosic fibers in an amount ranging from between about 0.01 to about 20 kilograms per metric ton;

b) dewatering said fiber slurry to remove said dye which was unadsorbed; and c) redispersing said cellulosic fibers in said fiber slurry with fresh water.

30. The method of claim 29 wherein said dye is an acid dye.

31. The method of claim 29 wherein said dye is a basic dye.

32. The method of claim 29 wherein said dye is a direct dye.

33. The method of claim 29 wherein said dye is a cellulose reactive dye.

34. The method of claim 29 wherein said dye is a pigment.

35. The method of claim 29 wherein said dye is applied to said cellulosic fibers to alter the color of said fibers.

36. The method of claim 29 wherein said dye is added to said water and said cellulosic fibers in an amount of about 0.01 kilograms per metric ton or greater.

37. The method of claim 29 wherein said dewatering increases the consistency of said fiber slurry to about 30 percent or greater.

38. A method for applying a dye to cellulosic fibers, said method comprising the steps of:

a) creating a first fiber slurry of cellulosic fibers, water and an adsorbable dye, said dye being adsorbed onto said cellulosic fibers in an amount ranging from between about 0.01 to about 20 kilograms per metric ton;

b) creating a second fiber slurry that is substantially free of any adsorbable dye;

c) dewatering said first fiber slurry to remove said dye which was unadsorbed;

d) redispersing said cellulose fibers in said first fiber slurry with fresh water; and e) forming a paper product using a layered headbox having a first layer and a second layer, said first fiber slurry being directed to said first layer and said second fiber slurry being directed to said second layer.

39. The method of claim 38 wherein said dye is applied to said cellulosic fibers to alter the color of said fibers.

40. The method of claim 38 further comprising forming a paper product having a plurality of layers, with one of said layers being formed from said first fiber slurry.

41. The method of claim 38 wherein said dye is a direct dye.

42. The method of claim 38 wherein said dye is a basic dye.

43. The method of claim 38 wherein said dye is a pigment.

44. A method for applying a dye to cellulosic fibers, said method comprising the steps of:

a) creating a fiber slurry containing water, cellulosic fibers and a first adsorbable dye;

b) dewatering said fiber slurry to remove said dye which was unadsorbed, said fiber slurry having a consistency of about 20 percent or greater;

c) passing said dewatered fiber slurry through a disperser to mechanically work said cellulosic fibers;

d) diluting said fiber slurry with fresh water to a consistency of about 5 percent or less;

e) adding a second adsorbable chemical additive to said fiber slurry;

f) dewatering said fiber slurry to a consistency of about 20 percent or greater;

g) diluting said fiber slurry with fresh water to a consistency of about 5 percent or less; and h) forming a paper product from said fiber slurry.

45. The method of claim 44 wherein said second adsorbable chemical is a debonding agent.

46. The method of claim 44 wherein said second adsorbable chemical is a softening agent.

47. The method of claim 44 wherein said dye is a direct dye.

48. The method of claim 44 wherein said dye is a basic dye.

* * * * *